US006123624A

United States Patent [19]

Santini

[11] Patent Number: 6,123,624

[45] Date of Patent: Sep. 26, 2000

[54] BOWLING PIN AND METHOD OF PLAYING A BOWLING GAME

[76] Inventor: Louis A. Santini, 38 Teresa Pl., Bridgeport, Conn. 06606

[21] Appl. No.: 09/299,675

[22] Filed: Apr. 26, 1999

Related U.S. Application Data

[60] Provisional application No. 60/083,218, Apr. 27, 1998.

[51] Int. Cl.[7] ..... A63B 9/00

[52] U.S. Cl. ..... 473/118; 473/124

[58] Field of Search ..... 473/118, 119, 473/120, 121, 122, 123, 124

[56] References Cited

U.S. PATENT DOCUMENTS

| | | |
|---|---|---|
| 1,642,286 | 9/1927 | Wuerthele . |
| 2,484,293 | 10/1949 | Hinchliff . |
| 3,102,724 | 9/1963 | Schmid . |
| 3,174,751 | 3/1965 | Martin . |
| 4,893,814 | 1/1990 | Bertozzi . |

*Primary Examiner*—William M. Pierce

[57] ABSTRACT

A bowling pin and method for playing a bowling game. The bowling pin includes a cylindrical section which straddles the location at which the ball contacts the pin. Several alternate scoring methods are disclosed for both sport and recreation.

18 Claims, 15 Drawing Sheets

NAME COLUMN

FRAME OR BOX

TOTAL COLUMN

STRIKE

SPARE

MISS

FOUL

CHOP OR SPLIT

| NAME | F1 | F2 | F3 | F4 | F5 | F6 | F7 | F8 | F9 | F10 | F11 | F12 | TOTAL |
|---|---|---|---|---|---|---|---|---|---|---|---|---|---|
| 1 | | | | | | | | | | | | | |
| 2 | | | | | | | | | | | | | |
| 3 | | | | | | | | | | | | | |
| 4 | | | | | | | | | | | | | |
| 5 | | | | | | | | | | | | | |

| | | | |
|---|---|---|---|
| STRIKE | X | V | 15+ 1 BALL |
| SPARE | 7 | / | 10 + 1 BALL |
| OPEN | 8 | 1 | COUNT |

| | | | | | | | | | | | | |
|---|---|---|---|---|---|---|---|---|---|---|---|---|
| X V | 9 / | 7 2 | X V | X V | 3 / | 8 - | 2 4 | 7 / | 7 F | - / | 7 / X | IN F12 STRIKE=25 SPARE=20 OPEN = COUNT |
| 24 | 41 | 50 | 78 | 93 | 111 | 119 | 125 | 142 | 149 | 166 | 186 | |

| NAME | F1 | F2 | F3 | F4 | F5 | F6 | F7 | F8 | F9 | F10 | F11 | F12 | TOTAL |
|---|---|---|---|---|---|---|---|---|---|---|---|---|---|
| 6 | | | | | | | | | | | | | |
| 7 | | | | | | | | | | | | | |
| 8 | | | | | | | | | | | | | |
| 9 | | | | | | | | | | | | | |
| 10 | | | | | | | | | | | | | |

FIG. 6

NAME COLUMN

FRAME OR BOX

TOTAL COLUMN

STRIKE

SPARE

STAR

PLUS

MISS

CHOP

SPLIT

FOUL

| NAME | F1 | F2 | F3 | F4 | F5 | F6 | TOTAL |
|---|---|---|---|---|---|---|---|
| 1 | | | | | | | |
| 2 | | | | | | | |
| 3 | | | | | | | |
| 4 | | | | | | | |
| 5 | | | | | | | |

| | | | | | | | |
|---|---|---|---|---|---|---|---|
| | X | 7 / | 6 3 * | 4 3 2 + | 2 3 4 - | 9 / | 189 |
| | 50 | 90 | 120 | 140 | 149 | 187 | |

| | |
|---|---|
| STRIKE (X) = 50 | |
| SPARE (/) = 40 | |
| STAR (*) = 30 | |
| PLUS (+) = 20 | |
| OPEN ( ) = COUNT | |

| NAME | F1 | F2 | F3 | F4 | F5 | F6 | TOTAL |
|---|---|---|---|---|---|---|---|
| 6 | | | | | | | |
| 7 | | | | | | | |
| 8 | | | | | | | |
| 9 | | | | | | | |
| 10 | | | | | | | |

FIG. 8

NAME COLUMN

FRAME OR BOX

TOTAL COLUMN

STRIKE

SPARE

STAR

CHOP

MISS

FOUL

SPLIT

| NAME | F1 | F2 | F3 | F4 | F5 | F6 | F7 | F8 | F9 | F10 | TOTAL |
|---|---|---|---|---|---|---|---|---|---|---|---|
| 1 | | | | | | | | | | | |
| 2 | | | | | | | | | | | |
| 3 | | | | | | | | | | | |
| 4 | | | | | | | | | | | |
| 5 | | | | | | | | | | | |

| | | | | | | | | | | | |
|---|---|---|---|---|---|---|---|---|---|---|---|
| | X | | 7 / | 6 3 * | 4 4 1 | X | X | 1 6 1 | 7 1 1 | 8 / | 4 4 1 | |
| | 30 | | 50 | 65 | 74 | 104 | 134 | 142 | 151 | 171 | 180 | |

STRIKE (X) = 30
SPARE (/) = 20
STAR (*) = 15
OPEN ( ) = COUNT

| NAME | F1 | F2 | F3 | F4 | F5 | F6 | F7 | F8 | F9 | F10 | TOTAL |
|---|---|---|---|---|---|---|---|---|---|---|---|
| 6 | | | | | | | | | | | |
| 7 | | | | | | | | | | | |
| 8 | | | | | | | | | | | |
| 9 | | | | | | | | | | | |
| 10 | | | | | | | | | | | |

FIG. 10

NAME COLUMN

FRAME OR BOX

TOTAL COLUMN

STRIKE

SPARE

STAR

PLUS

DIAMOND

MISS

CHOP

SPLIT

FOUL

NAME COLUMN

FRAME OR BOX

TOTAL COLUMN

STRIKE

MISS

CHOP

FOUL

SPLIT

| NAME | F1 | F2 | F3 | F4 | F5 | F6 | F7 | F8 | F9 | F10 | F11 | F12 | F13 | F14 | F15 | F16 | F17 | F18 | F19 | F20 | TOTAL |
|---|---|---|---|---|---|---|---|---|---|---|---|---|---|---|---|---|---|---|---|---|---|
| 1 | | | | | | | | | | | | | | | | | | | | | |
| 2 | | | | | | | | | | | | | | | | | | | | | |
| 3 | | | | | | | | | | | | | | | | | | | | | |
| 4 | | | | | | | | | | | | | | | | | | | | | |
| 5 | | | | | | | | | | | | | | | | | | | | | |
| STRIKE (X) = 15 | X | 7 | 9 | X | X | 6 | 5 | X | 9 | F | X | 8 | 9 | 2 | X | X | X | 6 | 4 | X | |
| OPEN ( ) = COUNT | 15 | 22 | 31 | 46 | 61 | 67 | 72 | 87 | 96 | 96 | 111 | 119 | 128 | 130 | 145 | 160 | 175 | 181 | 185 | 200 | |

| NAME | F1 | F2 | F3 | F4 | F5 | F6 | F7 | F8 | F9 | F10 | F11 | F12 | F13 | F14 | F15 | F16 | F17 | F18 | F19 | F20 | TOTAL |
|---|---|---|---|---|---|---|---|---|---|---|---|---|---|---|---|---|---|---|---|---|---|
| 6 | | | | | | | | | | | | | | | | | | | | | |
| 7 | | | | | | | | | | | | | | | | | | | | | |
| 8 | | | | | | | | | | | | | | | | | | | | | |
| 9 | | | | | | | | | | | | | | | | | | | | | |
| 10 | | | | | | | | | | | | | | | | | | | | | |

FIG. 14

BOWLING PIN AND METHOD OF PLAYING A BOWLING GAME

CROSS REFERENCE TO RELATED APPLICATIONS

This application claims the benefit to U.S. provisional patent application Ser. No. 60/083,218 filed Apr. 27, 1998.

BACKGROUND OF THE INVENTION

The present invention includes a pin, scoring methods, lane courtesy rules and lane conditioning for use in a bowling game and in particular, for use with the duckpin bowling game. The current duckpin bowling game is a very excellent game for recreational purposes, but as a sport it is far too challenging for general bowling public acceptance. The other bowling games are also deficient in their sport worthiness. For a bowling game to be considered a sport, it must be challenging but it also must be considered a fair game by the bowling public. The bowling game that needs the least re-design is the current ten pin duckpin bowling game.

The main deficiency of the current duckpin is the contribution it makes in the inability of a bowler to get an appropriate number of strikes, especially clean strikes. This is true even when the skill level of the player is very high. Which is to say that the bowlers can not bring their skill to bear on the game.

Referring to FIGS. 1 and 2, a strike occurs when the ball (10) makes contact with the pins in one of the two strike pockets (between the 1 and 2 pins or between the 1 and 3 pins as shown in FIGS. 1 and 2). The ball (10) enters the pocket area at a moderate angle and is rolling well (not sliding). If these conditions are met, the usual result should be a strike. When the ball makes contact with the pins in the pocket and all the pins and the ball go into the pit without assistance from the side boards or any other physical surrounding, a clean strike results.

With a clean strike, four separate actions take place. They take place in such rapid succession that they appear to take place simultaneously. For better appreciation of proper ball deflection and pin action and reaction, the four sequences are described below with reference to a right side pocket hit shown in FIG. 1.

1. The ball makes contact with the 1 pin and drives it back so that the 1 brings down the 2, the 2 in turn brings down the 4 and the 4 pin brings down the 7.
2. The 1 pin will deflect the ball onto the 3 pin, the 3 pin will be driven back so that it brings down the 6 pin and the 6 pin will bring down the 10 pin.
3. The 3 pin will deflect the ball onto the 5 pin, the 5 pin will bring down the 8 pin.
4. The 5 pin will deflect the ball onto the 9 pin to finish the ball and pin actions for a clean strike.

The ball and pins all go into the pit without the aid of the sideboards, channel tracks or any other physical surrounding.

A left side pocket hit, shown in FIG. 2, also has four separate action sequences similar to those described above with reference to the right side pocket hit. In the left side pocket hit, the ball makes contact with the 1, 2, 5 and 8 pins. With the current duckpins, even though the bowler makes a good pocket delivery a strike is the unusual result rather than the usual result, primarily because of the flying pin action described herein. An objective of the present invention is to make strikes the usual result when the bowler makes an appropriate delivery. The current duckpin (12) is shown in FIG. 3 and is described in detail below. Due to the pin's tapered shape at the area of contact with the ball, and other factors, there is a great tendency for the ball to lift the pin up and away, instead of straight back, thereby creating a "flying pin."

The pin that is contacted by the ball is lifted up and back. When it makes contact with the next standing pin, it makes contact above the widest point of the standing pin and below the widest point of the flying pin. This means that contact between the pins is made at a point where the width of both pins is reduced and so, the margin for error is reduced. This results in very erratic pin fall and reduces the margin for error from very low to practically non existing.

Even though the ball contact with the pin only lifts the pin an inch or so, at times it seems that the current duckpins are lifted several feet, but that is due to the assist the flying pin receives from the contact with the next standing pin. The tapered shape of both pins serves to propel the flying pin to a greater height. Flying pins that are driven to the side boards can also be propelled to a greater height and in the process missing any standing pins that they might otherwise knock-down (poor pin action).

Other factors contribute to the flying pin problem such as weight distribution of the pin and small diameter of the tip at the base of the pin. These other factors however have a positive side. The help the pin fall over with very light contact from other pins (or the ball). Because of the positive side in the other factors only minor changes are planned for them.

The low margin for error starts with the flying action of the pins and is reduced further by the small width of the pin. The problem manifests itself most with a full set of 10 pins when the bowler's goal is to get a strike. It also manifests itself when there are less than 10 pins standing when a bowler's goal is to get a spare. The negative impact of the flying pin is reduced and disappears with only 1 pin standing. The low margin for error due to the small diameter of the pin is always there even with just 1 pin standing. The need to increase the margin for error so that there is a substantial increase in scores is crucial to higher acceptance of the duckpin game by the bowling public.

Another drawback of the current duckpin bowling game is the scoring method. The current duckpin scoring system allows up to 3 balls per frame (box) to knock down all ten pins. A game consists of 10 frames. There are a maximum of 30 balls per game. Perfect score is 300. Downing all the pins with the first ball is a strike. A strike is worth 10 plus all pins knocked down with the next 2 balls. The maximum score for a strike frame is 30. Maximum score for all strikes in one game (12 strikes) is 300.

Downing all the pins with the first 2 balls is a spare. A spare is worth 10 plus all the pins knocked down with the next ball. The maximum score for a spare frame is 20. The maximum score for all spares in one game (10 spares) is 190. Downing all the pins with 3 balls produces a maximum count of 10. The maximum score for a game without a strike or spare is 100.

The current duckpin scoring method is not commensurate with the level of difficulty of the game. The scores are too low for general bowling public acceptance. From the business standpoint (and the bowler's standpoint) the game takes too long. The maximum number of balls per game is 30. In addition, the symbols and scoring forms used for scoring are not standardized.

Yet another drawback to the current duckpin bowling game is the lane conditioning. In the current duckpin bowling game, the use of oil on the lane is not a widespread misconception but when it is used it is detrimental to good scoring, fairness of the game and bowling as a desirable activity for the general public. Use of oil on a bowling lane while the bowlers are playing the game is unfair to the bowlers and to the bowling center. The presence of oil will exaggerate any error the bowler makes on his/her delivery. The oil also gets on the ball and then on the bowler's hand which can make the ball slip from his/her hand as he/she makes his/her delivery. In addition, the oil on the ball will redeposit on another part of the lane resulting in "spotty conditions."

The oil goes from the ball to the pins and on to the pin setting machinery which contribute to machine malfunction. Oil is not only a detriment to fair scoring anytime, but if left on the lane long enough makes fair scoring impossible. The oil will attract dirt, dust, grease and grime which will make a delivered ball slow down, slip and slide, speed up, slow down, change direction and in the process take away the ball's roll which is crucial to knocking the pins down.

Generally, it can be said that oil on the plate (pin deck) has a positive effect on scoring as it helps the pins slide back rather then flying up. But its help is inconsistent due to the nature of oil. Even under the most meticulous use (where the plates are cleaned before application of new oil, where the same amount is applied evenly on every plate and applied at the same time), in a short time the oil will evaporate, be picked up by the ball or be picked up by the pins and thereby contributing to all the problems mentioned for using oil on the lane.

SUMMARY OF THE INVENTION

The above-discussed and other drawbacks and deficiencies of the prior art are overcome or alleviated by the bowling pin and method of playing a bowling game of the present invention. The duckpin bowling game of the present invention will meet the requirements of a challenging but fair game, which will lead to acceptance of duckpin bowling as a major bowling sport, and eventually as a major sport on the order of baseball, soccer, etc. The duckpin game will continue to enhance the game's recreational applications with 4 of 5 scoring methods specifically designed for recreational use. Recreational play of the current duckpin game is very popular and an important source of income for the bowling centers that cannot be overlooked.

The invention includes improvements to physical and procedural aspects of the duckpin bowling game. In the duckpin bowling game of the invention, the pin design is the only physical characteristic that will change. Other physical characteristics of the game such as the ball, the lane, the pin deck, side boards, etc. are considered constraints and will not be addressed. The scoring systems, lane conditioning standard and lane courtesy standard are addressed and are included in the invention. The duckpin game of the invention is designed with the current ten pin duckpin game in mind, however, use of the invention is not limited to the current duckpin bowling centers. Any of the indoor bowling centers that are generally the same (e.g. lane 60 feet long, 41 inches wide, etc.) can convert to the duckpin game of the present invention.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES:

FIG. 6 depicts a score sheet using the first scoring method;

FIG. 8 depicts a score sheet using the second scoring method;

FIG. 10 depicts a score sheet using the third scoring method;

FIG. 14 depicts a score sheet using the fifth scoring method.

DETAILED DESCRIPTION OF THE PREFERRED EMBODIMENTS

Figure 4:
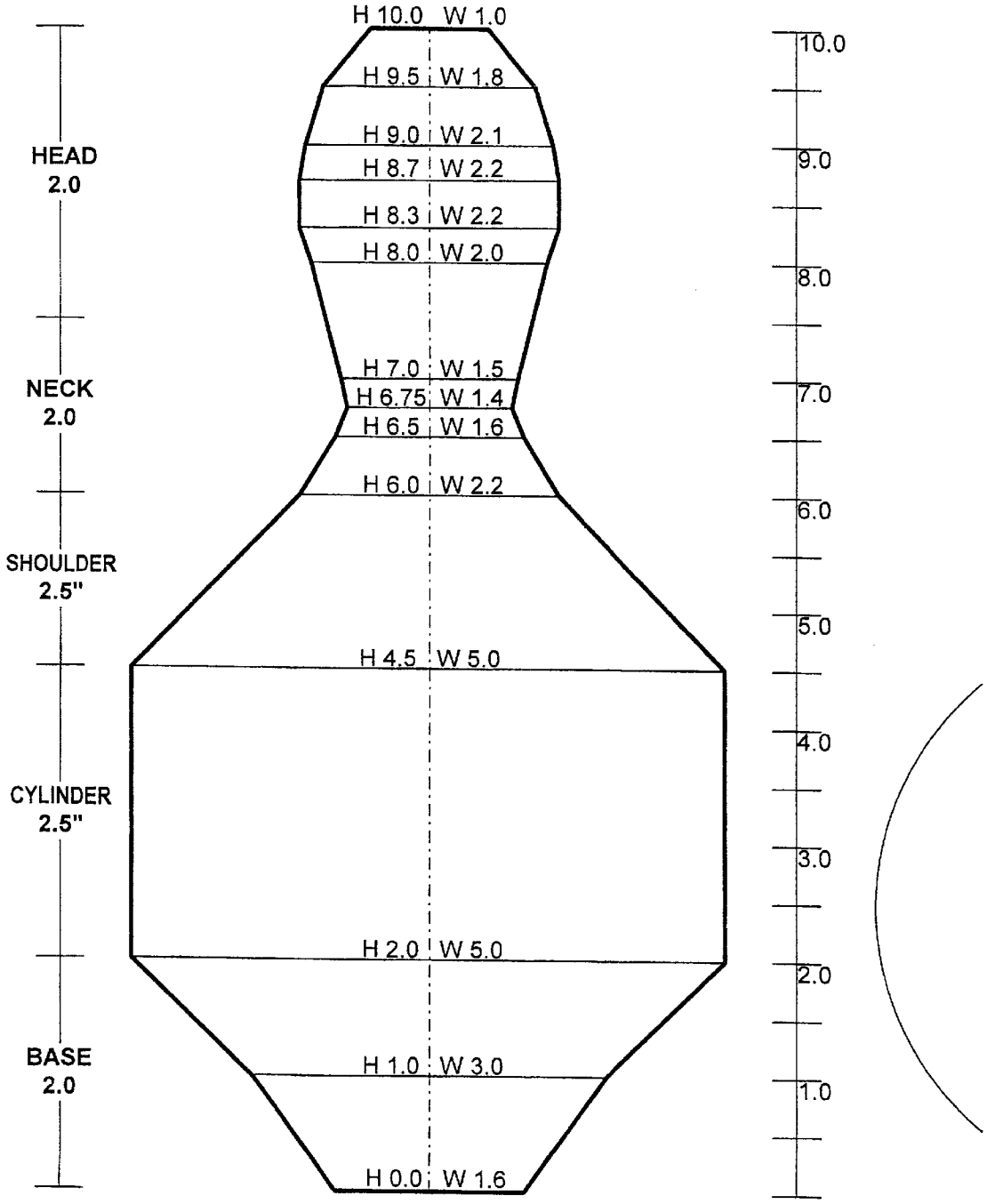
FIG. 4 depicts a duckpin in an embodiment of the invention.

FIG. 4 is a side view of a duckpin (100) in an exemplary embodiment of the invention. As described in detail herein, the duckpin (100) includes a cylindrical section (102) as opposed to a tapered shape of the current pin. By redesigning the pin's area of contact with the ball to a cylindrical shape, the pin action will be made more predictable. The cylindrical section (102) will eliminate the tapered shape's contribution to the flying pin problem and will neutralize any residual flying pin problem due to the other contributing factors. In so doing, the margin for error will be increased. Additionally, the margin for error will be increased by increasing the width of the pin. The above will evidence itself by a significant increase in the number of strikes that duckpin bowlers will attain.

Figure 1:
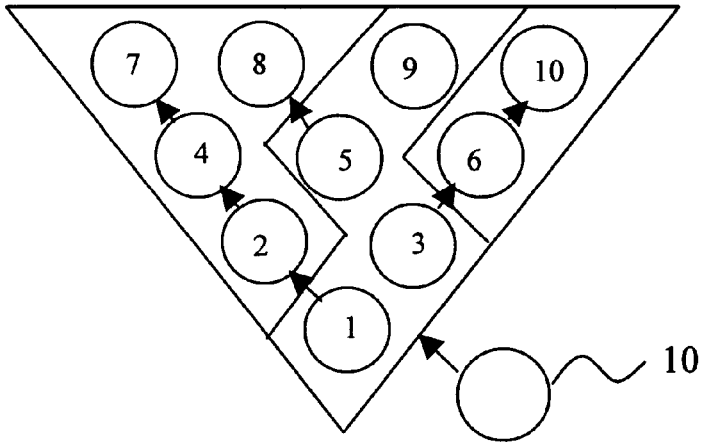
FIG. 1 depicts pin action in a right side pocket hit.
Figure 2:
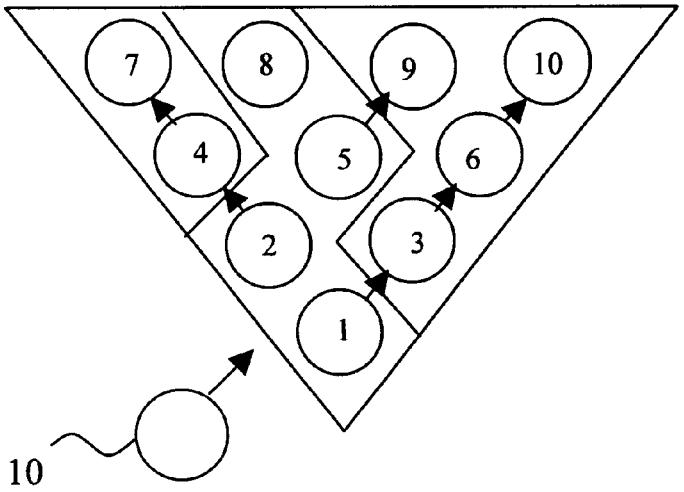
FIG. 2 depicts pin action in a left side pocket hit.
Figure 3:
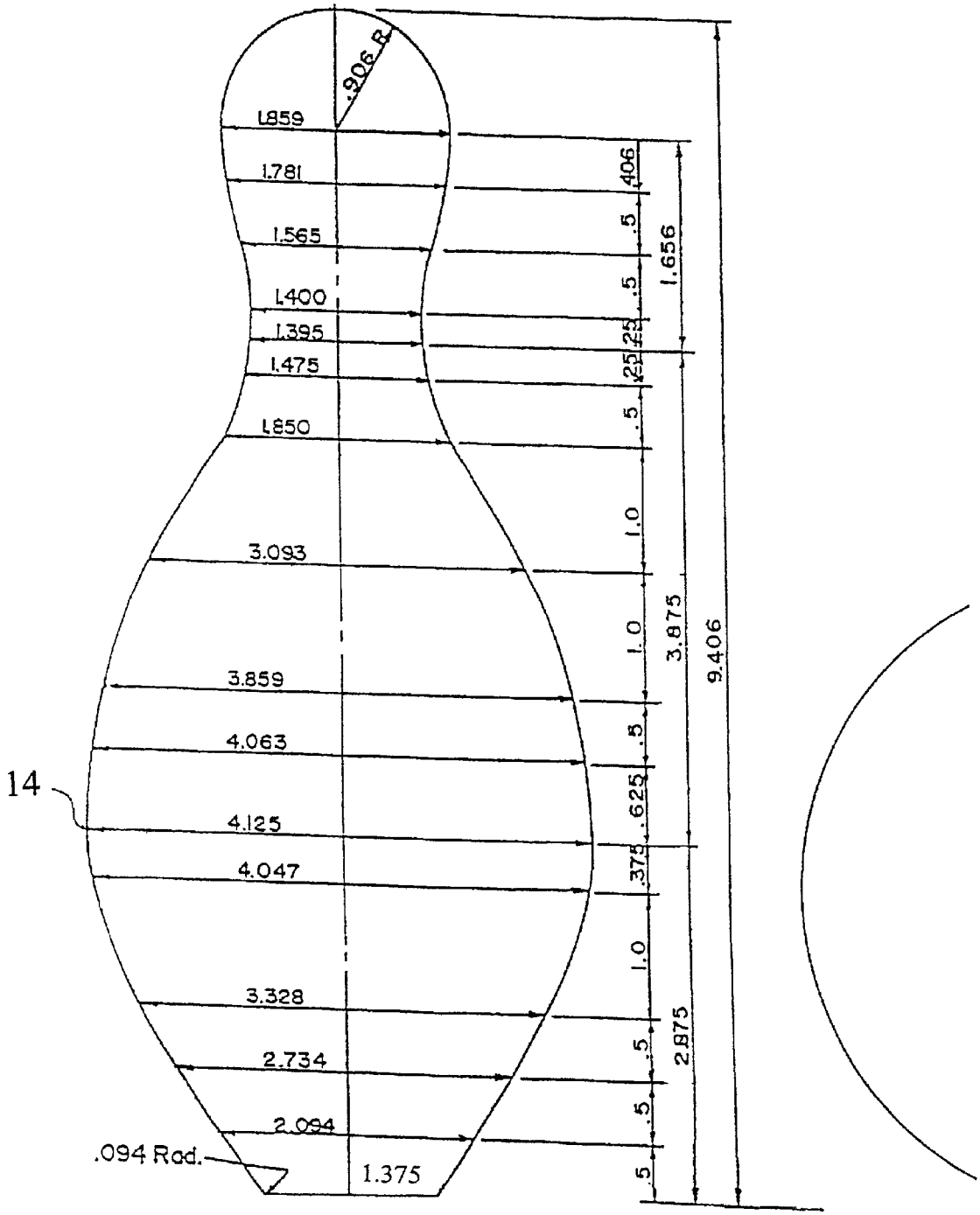
FIG. 3 depicts a conventional duckpin.

Referring to FIG. 3, the widest part (14) of the current pin (12) exists at a point 2.875" from the bottom. At this point the pin is 4.125" wide and has a tapered shape reducing in width in both directions to be tapered toward the bottom and toward the top (18). Because the tapering starts right at the 2.875" point, the widest part (14) is itself only a hairline wide. The tapered shape reduces the margin for error because when the flying pin makes contact with next standing pin, contact is made above the widest point of the standing pin and below the widest point of the flying pin. The reduction in width of the contact point reduces the margin for error and brings about erratic pin action.

Also, the conventional pin's tapered shape contributes to the pin spinning around when 1 or more pins come back from the side boards onto the pin deck. When the pin is on its side the hairline that is the widest part (14) of the pin becomes like the point of a spinning top and the rest of the pin becomes the top. The occasional pin fall that results from this action is not worth the time it takes for the pins to stop spinning so that the downed pins can be cleared away and any standing pins reset or a new set of 10 pins set up and the bowler can make his/her next delivery.

The ball/pin contact point varies due to the ball size varying from 5.0" in diameter to 4.75" in diameter and the pin deck being lowered in some bowling centers up to 0.5". If the ball (10) and pin (12) meet below the 2.875" point, the pin (12) provides the ball (10) with a convenient leverage point and the pin has its greatest tendency to be lifted up and away. The further below the 2.875" point contact is made the higher the pin is lifted. If the ball and pin meet precisely at the 2.875" point, the amount of lift is reduced but not eliminated because of the other factors involved. If the ball and pin meet far enough above the 2.875" point, erratic ball deflection will bring about unpredictable results as well.

FIG. 4 is a side view of a duckpin (100) in an exemplary embodiment of the invention. The height (H) and width (W) values are exemplary. Duckpin (100) includes a base portion (104) having a bottom surface (120) which rests on the pin deck. The bottom portion (104) has a diameter that increases from the bottom surface (120) to the lower edge (122) of cylindrical section (104). The outside surface of base portion (104) meets the outside surface of cylindrical section (102). Adjacent the base portion (104) is a cylindrical section (102) starting approximately 2.0" from the bottom surface (120) and extending for approximately 2.5". The cylindrical section (102) is adjacent a shoulder portion (107) and joins shoulder portion at an upper edge (124). The outside surface of shoulder portion (107) meets the outside surface of cylindrical section (102). The shoulder portion (107) has a diameter that decreases from the cylindrical portion (102) to a neck portion (108). A neck portion (108) is adjacent to the shoulder portion (107) and has and has a diameter that varies as measured from bottom surface (120). The diameter of the neck portion (108) first decreases and then increases as measured from the bottom to the top of the duckpin (100). The neck portion 108 joins head portion (112). Head portion (112) has a diameter that increases and then decreases as measured from bottom surface (120). Although the duckpin (100) is shown as being made up of frusto-conical sections and cylindrical sections, it is understood that different geometries may be used for the various portions of the duckpin as long as cylindrical portion (102) remains. Duckpin (100) is made from a unitary piece of material (e.g. plastic) and thus all portions are integral to each other.

The cylindrical portion (102) straddles the ball contact area located 2.5" from the bottom (assuming a ball having a 5" diameter and the pin deck is at the same level as the lane). The dimensions in FIG. 4 are exemplary. The distance between the bottom surface and lower edge (122) is less than the ball radius. The distance between the bottom surface and upper edge (124) is greater than the ball radius. The ball (10) will never make contact below or above the cylindrical portion (102) of pin (100). There is no convenient leverage point for the ball (10) to use for lifting the pin (100).

The cylindrical portion (102) increases the margin for error, even if there is residual flying pin action due to the other factors involved. Contact between a lifted pin and the next standing is still made at their widest point provided the flying pin is not lifted more than 2.5". If testing shows that it happens frequently, the cylindrical portion can be increased from 2.5" to 3.0" or more if needed. The cylindrical portion (102) will reduce the spinning ways of the pin. When the pin (100) is on its side there is no tip for the pin to spin on.

Pins having dimensions other than those shown in FIG. 4 may be manufactured so the current duckpin setting machine can be used in testing the duckpin of the present invention. For example, the width of the pin (100) at its widest point may be altered to 4.5" instead of 5.0" because of constraints of the current duckpin return mechanism of the current duckpin machine. These alternative embodiments would retain the cylindrical section (102).

A comparison of characteristics of the conventional pin (12) and the duckpin (100) in an exemplary embodiment of the invention will now be provided. The widest part (14) of the conventional pin (12) measures 4.125". The distance between each adjacent pin measured from center of each is 12.0". The gap between the columns of pins is 1.875". In practice the gap is more like 2.0" because the ball usually makes contact below the widest point. Due to the big gap between columns of pins the frequency of a chop occurring is too great and the strike pocket area is far too small. This leads to a high frustration level for the bowler and the resulting low scores are a reflection of that frustration.

The widest part of pin (100) is 5.0" wide. The gap between columns of pins is reduced to 1.0". This will mean a reduction in frequency of a chop occurring and an increase in the size of the strike pocket area. The bowler's frustration level will be reduced and the scores will be increased.

The size of the tip at the bottom of the current pin (12) is small, 1.375" wide. This is both an advantage and a disadvantage. It is desirable because a standing pin can be downed with very light contact from another pin or the ball. However, it does contribute to the flying action of the pins and if slightly damaged from constant use, it can contribute to the occasional pin setting machine's inability to setup all ten pins without one or more of the pins falling over.

The width of the bottom of pin (100) is 1.65". This small increase is in line with the increase in the maximum width pin (100). The small change with this factor is an effort to reduce its contribution to the flying pin problem and to retain some of the advantage in easy toppling of the current pin.

The current duckpin (12) has a length of 9.406. The ball (10) makes contact with the pin (12) in a region of 2.375" from the bottom to 3.0" from the bottom. Relative to the point of contact, the pin (12) has a top portion that is more than 6" long and the bottom portion of 3.0" or less. This gives the pin (12) a natural top heavy characteristic. The variation in contact point is due to the varying size of the ball from a minimum of 4.750" to 5.0" in diameter and because the pin deck is lowered up to 0.5". A top heavy pin has an advantage and a disadvantage. It is desirable because a standing pin can be downed with very light contact from another pin or the ball. However, it does contribute to the flying action of the pins.

The duckpin (100) in an exemplary embodiment of the invention will have a moderate increase in bottom weight and a moderate reduction in top weight. A moderate change of this factor is an effort to retain some of the advantage of easy toppling of the current pin.

The overall weight of the current duckpin (12) is 1 pound, 6 ounces and length is 9.406". To the extent possible, these factors will be considered a constraint for the pin (100). Ball deflection ability and durability of the current duckpin (12) varies slightly with the manufacturer. The duckpin (100) in an exemplary embodiment of the invention will have ball deflection ability and durability consistent with the current duckpin (12).

Although the pin (100) described above will enhance play of the current duckpin game, the present invention also includes a plurality of scoring methods to further improve the current duckpin game. A first scoring method of the present invention allows up to 2 balls per frame to knock down all ten pins. A game consists of 12 frames and thus, there are a maximum of 24 balls per game. A perfect score is 300.

Downing all the pins with the first ball is a strike. A strike is worth 15 plus all the pins knocked down with the one next ball. The maximum score for a strike frame is 25. The maximum score for all strikes in one game (12 strikes) is 300. There is an added bonus in the 12th frame in which a strike is worth 25 without delivering another ball. Downing all the pins with 2 balls is a spare. A spare is worth 10 plus all the pins knocked down with the one next ball. The maximum score for a spare frame is 20. The maximum score for all spares in one game (12 spares) is 229. There is an added bonus in the 12th frame in which a spare is worth 20 without delivering another ball. The maximum score for a game without a spare or strike is 108.

The first scoring method of the present invention generates scores (even if used with the current duckpins) which are substantially higher than the current scoring method. From the business standpoint (and the bowler's standpoint) the game takes less time. The maximum number of balls per game is only 24 as opposed to 30 with the current duckpin scoring method. The scoring symbols are standardized. In addition, there is a more exciting finish to a game with an automatic 10 count bonus for a strike or spare in the 12th frame. Unlike the current scoring method where a game can be 10, 11 or 12 frames long depending on whether or not a bowler attains a mark (and which type of mark), with the first scoring method everyone bowls 12 frames which is equal and fair for everyone. There is a possibility of a total score of 229 by obtaining all spares in one game. This is appropriate for the level of difficulty of the duckpin bowling game.

The first scoring method will now be described in detail with reference to FIGS. 5 and 6. The score attained in each of the 12 frames is added to the prior frame's total. This individual running total will end with the game's total score in the 12th frame. The total to column is used to show the team's total score. The following terminology is used in the first scoring method.

Pins or points—for score keeping purposes pins and points are synonymous. Although the word points is most accurate the word pins is a commonly accepted term.

Mark—a frame where all ten pins are downed with 1 or 2 deliveries of the ball is called a mark.

Open—a frame where less than 10 pins are downed is called an open. The score in that frame is equal to the count of pins downed.

FIG. 6 is a score sheet for use with the first scoring method and FIGS. 5A through 5H are portions of the score sheet explained in detail herein.

Figure 5A:
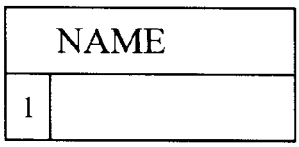
FIGS. 5A–5H depict portions of a score sheet in a first scoring method.

FIG. 5A illustrates the name column. It is where the player's name is entered. In bowling the terms player and bowler are synonymous.

Figure 5B:
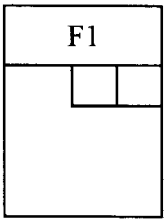

FIG. 5B illustrates a frame or box. The terms frame and box are synonymous. The end of frame is defined as when the maximum number of balls (i.e., 2) are delivered or when all the pins are knocked down.

Figure 5C:
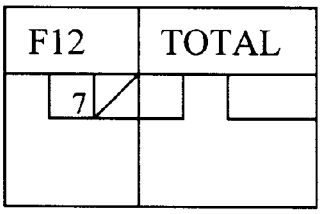

FIG. 5C illustrates the total column which is used to show the team's total score, the handicap (if any) and when a mark is attained in the 12th frame an "X" is used as the indicator of an automatic 10 count as shown in the sample score sheet in FIG. 6. If an open results in the 12th frame, the indicator is left blank.

Figure 5D:
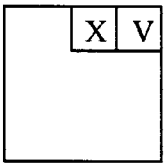

FIG. 5D illustrates a strike which occurs when all ten pins are downed with the first ball. It has a value of 15 plus the number of pins knocked down with the first ball in the next frame, which means a minimum score of 15 and a maximum score of 25. In frame 12, a strike is always worth 25 without delivering another ball. The symbols used to record a strike are XV which are the roman numerals for the arabic number 15.

Figure 5E:
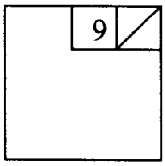

FIG. 5E illustrates a spare. When all 10 pins are downed with 2 deliveries of the ball it is called a spare. It has a value of 10 plus the number of pins knocked down with the first ball in the next frame, which means a minimum score of 10 and a maximum score of 20. In frame 12 a spare is always worth 20 without delivering another ball. The traditional bowling symbol for a spare is a slash (/).

Figure 5F:
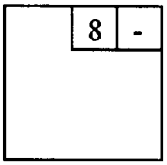

FIG. 5F illustrates a miss. A dash (-) is used to indicate that all the standing pins were missed by the ball. The score for the ball is zero. A dash is also used to record a gutter/channel ball.

Figure 5H:
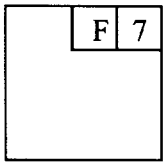
Figure 5G:
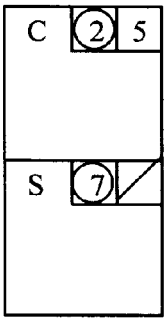

FIG. 5G illustrates a chop or split. A circle around the number of pins downed is used when the first ball in any frame results in a chop or a split. A chop occurs when the first ball knocks down one column of pins for example, the 1 and 5 pins. A split occurs when the first ball knocks down two or more columns of pins leaving a big gap between the standing pins. A chop or split makes it very difficult to attain a mark and therefore noteworthy C for a chop, S for a split can be added for clarity.

FIG. 5H illustrates a foul. The letter F is used when the bowler steps on the foul line or commits any other foul infraction. On a first ball foul, the score for the ball is zero. If the bowler knocked down less than 10 pins when he/she fouled, the bowler will roll a second ball in an effort to down the rest of the pins to attain a spare. If the bowler downed all 10 pins when he/she fouled, all ten pins are reset and the bowler delivers a second ball in an effort to get all ten pins down for a spare. On a second ball foul, the score for the ball is zero and the frame ends. Pins knocked down with the first ball is the score for the frame.

An alternative scoring method of the present invention is a second scoring method. This second scoring method allows up to 4 balls per frame to down all ten pins. A game consists of 6 frames. There are a maximum of 24 balls per game. A perfect score is 300. Downing all the pins with the first ball is a strike. A strike is worth 50. The maximum score for all strikes in one game (6 strikes) is 300. Downing all the pins with the first two balls is spare, a spare is worth 40. The maximum score for all spares in one game is 240. Downing all the pins with the first 3 balls is referred to as a star. A star is worth 30. The maximum score for all stars in one game is 180. Downing all the pins with 4 balls is referred to as a plus. A plus is worth 20. The maximum score for all plus game is 120. The maximum score for a game without a mark (X,/,*,+) is 54. The second scoring method is for people who like to play the game in an organized and scheduled way (i.e. league) where the accent is on recreation and somewhat less emphasis on the competition (sport).

The second scoring method will now be described in detail with reference to FIGS. 7 and 8. The score attained in each of the 6 frames is added to the prior frame's total. This individual running total will end with the game's total score in the 6th frame. The total column is used to show the team's total score. The following terminology is used in this second scoring method.

Pins or points—for score keeping purposes pins and points are synonymous. Although the word points is most accurate the word pins is the commonly accepted term.

Mark—a frame where all ten pins are downed within the maximum number of deliveries of the ball is called a mark.

Open—a frame where less than 10 pins are downed is called an open. The score that frame is equal to the count of pins downed.

FIG. 8 is score sheet for use with the second scoring method and FIGS. 7A–7K are portions of the score sheet explained in detail herein.

Figure 7A:
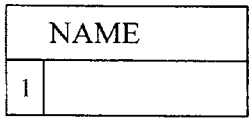
FIGS. 7A–7K depict portions of a score sheet in a second scoring method.

FIG. 7A illustrates the name column. The player's name is entered in this column. In bowling, the terms player and bowler are synonymous.

Figure 7B:
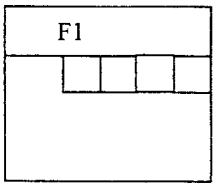

FIG. 7B illustrates a frame or box. The terms frame and box are synonymous. The end of frame is define as when the maximum number of balls are delivered (i.e., 4) or when all the pins are knocked down.

Figure 7C:
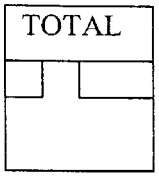

FIG. 7C illustrates the total column. The total column is used to show the team's total score and the handicap (if any).

Figure 7D:
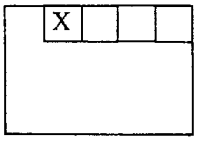

FIG. 7D illustrates a strike. When all the pins are downed with the first ball it is called a strike. It has a value of 50. The symbol used is the letter X.

Figure 7E:
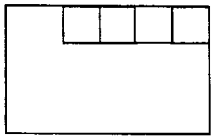

FIG. 7E illustrates a spare. When all the pins are downed with the first 2 balls it is called a spare. It has a value of 40. The symbol used is a slash (/).

Figure 7F:
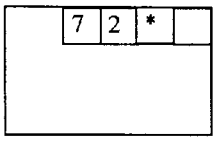

FIG. 7F illustrates a star. When all the pins are downed with the first 3 balls it is called a star. It has a value of 30. The symbol used is an asterisk (*).

Figure 7G:
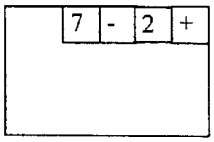

FIG. 7G illustrates a plus. When all 4 balls are needed to knock all the pins down it is called a plus. It has a value of 20. The symbol used is a plus sign (+).

Figure 7H:
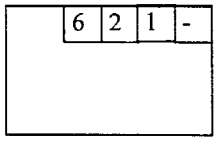

FIG. 7H illustrates a miss. A dash (-) is used to indicate that all the standing pins were missed by the ball. The score for the ball is zero. A dash is also used to record a gutter/channel ball.

Figure 7I:
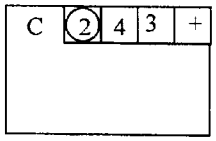
Figure 7J:
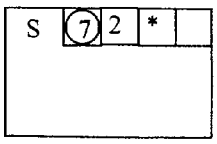

FIGS. 7I and 7J illustrate a chop and a split. A circle around the number of pins downed is used when the first ball in any frame results in a chop or a split. A chop occurs when the first ball knocks down one column of pins for example, the 1 and 5 pins. A split occurs when the first ball knocks down two or more columns of pins leaving a big gap between the standing pins. A chop or split makes it very difficult to attain a mark and therefore noteworthy C for a chop, S for a split can be added for clarity.

Figure 7K:
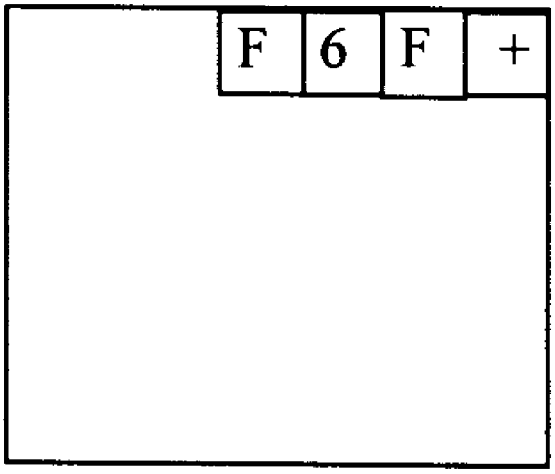

FIG. 7K illustrates a foul. The letter F is used when the bowler commits a foul such as stepping on the foul line. On a foul, the score for the ball is zero, any pins knocked down are reset and the bowler makes his/her next delivery. A mark is still possible unless the foul occurs on the fourth ball of the frame. In that event, the pins knocked down previously is the score for the frame.

An alternative scoring method of the present invention is a third scoring method. This alternative scoring method of the present invention allows up to 3 balls per frame to down all ten pins. A game consists of 10 frames. There are a maximum of 30 balls per game. A perfect score is 300. Downing all the pins with the first ball is a strike. A strike is worth 30. The maximum score for all strikes in one game (10 strikes) is 300. Downing all the pins with the first two balls is a spare, spare is worth 20. The maximum score for all spares in one game is 200. Downing all the pins with the first 3 balls is a star, star is worth 15. The maximum score for all stars in one game is 150. The maximum score for a game without a mark (X,/,*) is 90. This third scoring method is for people who like to play the game in an organized and scheduled way (i.e. league) where the accent is on recreation and somewhat less emphasis on the competition (sport).

The third scoring method will now be described in detail with reference to FIGS. 9 and 10. The score attained in each of the ten frames is added to the prior frame's total. This individual running total will end with the game's total score in the tenth frame. The total column is used to show the team's total score. The following terminology is used in this recreational scoring.

Pin or points—for score keeping purposes pins and points are synonymous. Although the word points is most accurate the word pins is the commonly accepted term.

Mark—a frame where all the pins are downed within the maximum number of deliveries of the ball is called a mark.

Open—a frame where less than ten pins are downed is called an open. The score in that frame is equal to the count of pins downed.

FIG. 10 is a score sheet for use with the third scoring method and FIGS. 9A–9J are portions of the score sheet explained in detail herein.

Figure 9A:
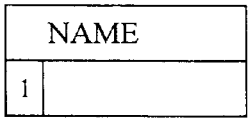
FIGS. 9A–9J depict portions of a score sheet in a third scoring method.

FIG. 9A illustrates the name column. The player's name is entered in this column. In bowling, the terms player and bowler are synonymous.

Figure 9B:
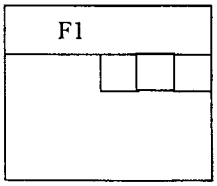

FIG. 9B illustrates a frame or box. The terms frame and box are synonymous. The end of frame is defined as when the maximum number of balls are delivered (3) or when all the pins are knocked down.

Figure 9C:
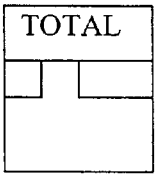

FIG. 9C illustrates the total column. The total column is used to show the team's total score and the handicap (if any).

Figure 9D:
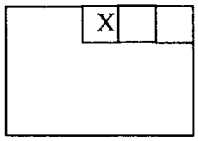

FIG. 9D illustrates a strike. When all the pins are downed with the first ball it is called a strike. It has a value of 30. The symbol used is the letter X.

Figure 9E:
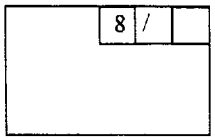

FIG. 9E illustrates a spare. When all the pins are downed with first two balls it is called a spare. It has a value of 20. The symbol used is a slash (/).

Figure 9F:
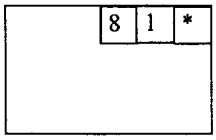

FIG. 9F illustrates a star. When all the pins are downed using all three balls it is called a star. It has a value of 15. The symbol used is an asterisk (*).

Figure 9H:
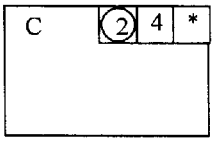
Figure 9G:
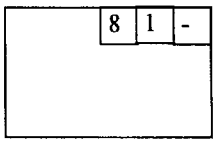

FIG. 9G illustrates a miss. A dash (-) is used to indicate that all the standing pins were missed by the ball. The score for the ball is zero. A dash is also used to record a gutter/channel ball.

Figure 9J:
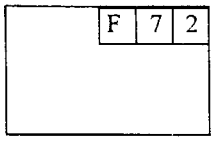
Figure 9I:
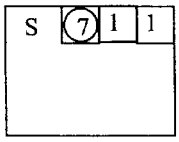

FIGS. 9H and 9I illustrate a chop and a split. A circle around the number of pins downed is used when the first ball in any frame results in a chop or a split. A chop occurs when the first ball knocks down one column of pins for example, the 1 and 5 pins. A split occurs when the first ball knocks down two or more columns of pins leaving a big gap between the standing pins. A chop or split makes it very difficult to attain a mark and therefore noteworthy C for a chop, S for a split can added for clarity.

FIG. 9J illustrates a foul. The letter F is used when the bowler commits a foul such as stepping on the foul line. On a foul, the score for the ball is zero, any pins knocked down are reset and the bowler makes his/her next delivery. A mark is still possible unless the foul occurs on the third ball of the frame. In that event, the pins knocked down previously is the score for the frame.

An alternative scoring method of the present invention is a fourth scoring method. This fourth scoring method of the present invention allows up to five balls per frame to down all ten pins. A game consists of five frames. There are a maximum of 25 balls per game. A perfect score is 300. Downing all the pins with the first ball is a strike and is worth 60. The maximum score for all strikes in one game (5 strikes) is 300. Downing all the pins with the first two balls is a spare and is worth 50. The maximum score for all spares in one game is 250. Downing all the pins with the first 3 balls is a star and is worth 40. The maximum score for all stars in one game is 240. Downing all the pins with the first 4 balls is a plus and is worth 30. The maximum score for an all plus game is 150. Downing all the pins with 5 balls is called a diamond and is worth 20. The maximum score for all diamond game is 100. The maximum score for a game without a mark (X,/,+,*,◇) is 45. The fourth scoring method is for people who like to play the game in an organized and scheduled way (i.e. league) where the accent is on recreation and somewhat less emphasis on the competition (sport).

The fourth scoring method will now be described in detail with reference to FIGS. 11 and 12. The score attained in each of the 5 frames is added to the prior frame's total. This individual running total will end with the game's total score in the 5th frame. The total column is used to show the team's total score. The following terminology is used in the fourth scoring method.

Pins or points—for score keeping purposes pins and points are synonymous. Although the word points is most accurate the word pins is the commonly accepted term.

Mark—a frame where all ten pins are downed within the maximum number of deliveries of the ball is called a mark.

Open—a frame where less than ten pins are downed is called an open. The score in that frame is equal to the count of pins downed.

Figure 11A:
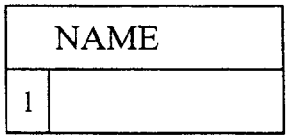
FIGS. 11A–11L depict portions of a score sheet in a fourth scoring method.
Figure 11B:
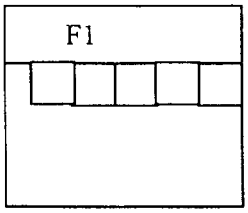
Figure 11C:
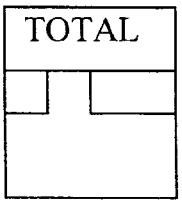
Figure 11D:
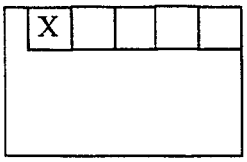
Figure 11E:
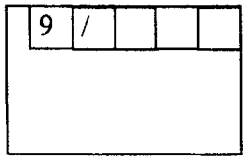
Figure 11F:
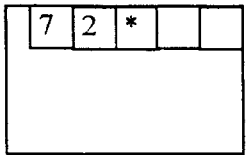
Figure 11G:
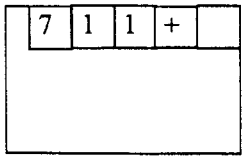
Figure 11H:
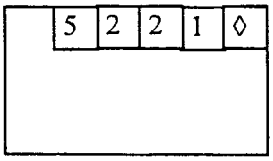
Figure 11I:
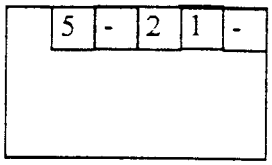
Figure 11J:
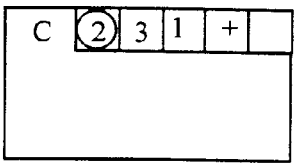
Figure 11K:
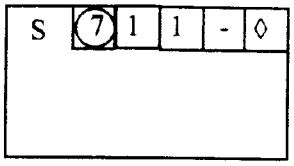
Figure 11L:
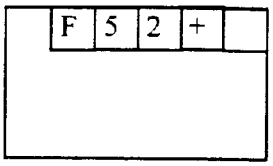
Figure 12:
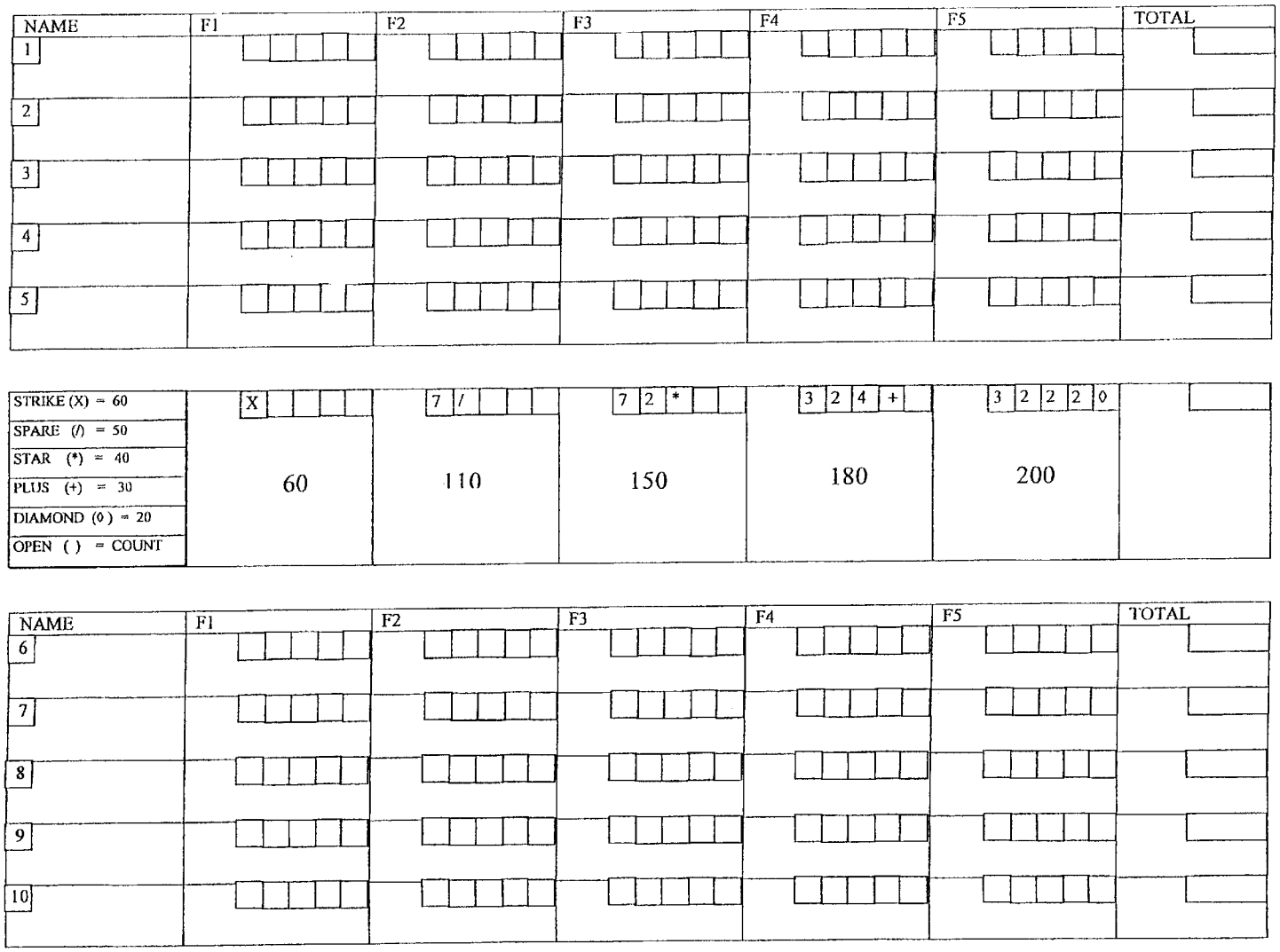
FIG. 12 depicts a score sheet using the fourth scoring method.

FIG. 12 is a score sheet for use with the fourth scoring method and FIGS. 11A–11L are portions of the score sheet explained in detail herein.

FIG. 11A illustrates the name column. The player's name is entered in this column. In bowling, the terms player and bowler are synonymous.

FIG. 11B illustrates a frame or box. The terms frame and box are synonymous. The end of frame is defined as when the maximum number of balls are delivered (i.e., 5) or when all the pins are knocked down.

FIG. 11C illustrates the total column. The total column is used to show the team's total score and the handicap (if any).

FIG. 11D illustrates a strike. When all the pins are downed with the first ball it is called a strike. It has a value of 60. The symbol used is the letter X.

FIG. 11E illustrates a spare. When all the pins are downed with the first 2 balls it is called a spare. It has a value of 50. The symbol used is a slash (/).

FIG. 11F illustrates a star. When all the pins are knocked down with the first 3 balls it is called a star. It has a value of 40. The symbol used is an asterisk (*)

FIG. 11G illustrates a plus. When the first 4 balls are needed to knock all the pins down it is called a plus. It has a value of 30. The symbol used is a plus sign (+).

FIG. 11H illustrates a diamond, when all 5 balls are needed to knock all the pins down it is called a diamond. It has a value of 20. The symbol used is a diamond (◇).

FIG. 11I illustrates a miss. A dash (-) is used to indicate that all the standing pins were missed by the ball. The score for the ball is zero. A dash is also used to record a gutter/channel ball.

FIGS. 11J and 11K illustrate a chop and a split. A circle around the number of pins downed is used when the first ball in any frame results in a chop or a split. A chop occurs when the first ball knocks down one column of pins for example, the 1 and 5 pins. A split occurs when the first ball knocks down two or more columns of pins leaving a big gap between the standing pins. A chop or split makes it very difficult to attain a mark and therefore noteworthy C for a chop, S for a split can be added for clarity.

FIG. 11L illustrates a foul. The letter F is used when the bowler commits a foul such as stepping on the foul line. On a foul, the score for the ball is zero, any pins knocked down are reset an the bowler makes his/her next delivery. A mark is still possible unless the foul occurs on the 5th ball of the frame. In that event, the pins knocked down previously is the score for the frame.

An alternative scoring method of the present invention is a fifth scoring method. This fifth scoring method of the present invention allows 1 ball per frame to down all ten pins. A game consists of 20 frames. There are 20 balls per game. A perfect score is 300. Downing all ten pins with the one ball is a strike. A strike is worth 15. The maximum score for all strikes in one game (20 strikes) is 300. Maximum score for a game without a mark (X) is 180. The fifth scoring method is for people who like to play the game in an organized and scheduled way (i.e., league) where the accent is on recreation and somewhat less emphasis on the competition (sport).

The fifth scoring method will now be described in detail with reference to FIGS. 13 and 14. The score attained in each of the 20 frames is added to the prior frame's total. This individual running total will end with the game's total score in the 20th frame. The total column is used to show the team's total score. The following terminology is used in this recreational scoring.

Pins or points—for score keeping purposes pins and Points are synonymous. Although the word points is most accurate the word pins is the commonly accepted term.

Mark—a frame where all ten pins are downed with the one delivery of the ball is called a mark.

Open—a frame where less than 10 pins are downed is called an open. The score in the frame is equal to the count of pins downed.

FIG. 14 is a score sheet for use with the fifth scoring method and FIGS. 13A–13H are portions of the score sheet explained in detail herein.

Figure 13A:
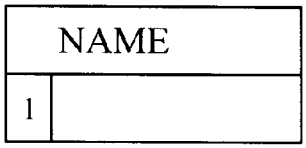
FIGS. 13A–13H depict portions of a score sheet in a fifth scoring method.

FIG. 13A illustrates the name column. The player's name is entered in this column. In bowling, the terms player and bowler are synonymous.

Figure 13B:
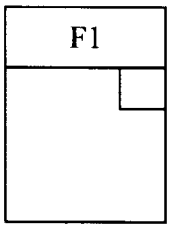

FIG. 13B illustrates a frame or box. The terms frame and box are synonymous. The end of frame is defined as when the bowler makes the one delivery.

Figure 13C:
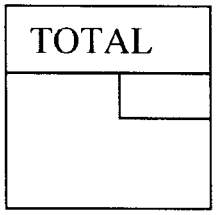

FIG. 13C illustrates the total column. The total column is used to show the team's total score and the handicap (if any).

Figure 13D:
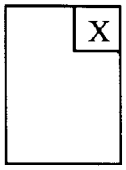

FIG. 13D illustrates a strike. When all the pins are downed with the one ball it is called a strike. It has a value of 15. The symbol used is the letter X.

Figure 13E:
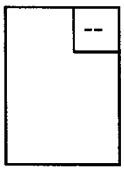

FIG. 13E illustrates a miss. A dash (-) is used to indicate that all the standing pins were missed by the ball. The score for the ball is zero.

Figure 13F:
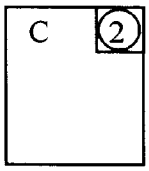
Figure 13H:
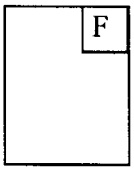
Figure 13G:
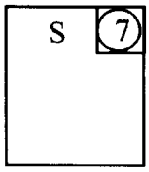

FIGS. 13F and 13G illustrate a chop and a split. A circle around the number of pins downed is used to indicate a chop or a split.

FIG. 13H illustrates a foul. The letter F is used When the bowler commits a foul such as stepping on the foul line. On a foul, the score for the ball (and frame) is zero.

When the first scoring method is used in organized play such as leagues, tournaments etc., the scores can be sanctioned by an existing national sanctioning organization such as the national duckpin bowling congress or a new national score sanctioning organization. Score sanctioning may be done for 3 game competition and for competition in multiples of 3 games only. The second through fifth scoring methods (recreational) are used in organized play. Score sanctioning can be done by the local bowling association or the bowling center.

The present invention also includes lane courtesy standards in order to provide safer and more enjoyable bowling. Bowling is played at close quarters. This constraint is, was and always will be a part of the game and thus, bowlers must be considerate of one another. Bowlers who start their delivery before the players on the next lanes step off the approach may cause non-intentional injury to the person who is trying to press the clear button or is trying to pick up a ball. Alternatively, he/she may be injured if the adjacent bowler become physical in their emotional release after a good shot (or a bad sot). In such a scenario, both bowlers may be injured.

Slow play is a problem for the business of bowling and the people who play the game have problems as well. Among other things, a long wait disrupts the rhythm needed for making good shots. Also, the game's high degree of difficulty demands great focus for good results. Standardized lane courtesy will reduce distractions.

As described above, lane courtesy rules in the current duckpin game seems to vary with the individual bowler. In the lane courtesy standard of the present invention, the bowler waits for one lane to the left and one lane to the right to clear before stepping on the approach to make his/her delivery. After each delivery he/she steps off the approach to allow the bowlers on the left and right to make their delivery (if they are ready).

One lane courtesy is the focus of the lane courtesy standard of the present invention. Should a bowler intentionally wait for two or more lane clearance a foul will result as written in the current national duckpin bowling congress rule book/directory The following courtesy rules apply when (1) the clear button and the reset button are located to the rear of the approach or are located off the approach and (2) the balls are returned to the rear of the approach or off the approach.

When the bowler is ready to bowl, he/she waits for 1 lane to the left and 1 lane to the right to clear, and then (1) picks up a ball, (2) steps on the approach and (3) assumes his/her stance and makes a delivery. After each delivery of the ball the bowler (4) steps off the approach, (5) clears the deadwood (if any) or resets the 10 pins (if it is time) and (6) allows the bowlers on the left and right to step up and make a delivery (if they are ready). When the box (frame) ends the bowler returns to the seating area.

Picking up the ball can be done any time provided it does not distract the bowlers already on their approach. Bowlers on the same pair of lanes, should not wait for the bowler on the opposing team to make an appearance or wait for the bowler on the right hand lane (or left hand lane) to bowl first as this is a waste of time.

When the clear button is located in the middle or front part of the approach and/or the balls are returned to the front or middle part of the approach, the courtesy procedure is the same except that after each delivery the bowler remains to the front or middle part of the approach to clear the deadwood and obtain a ball before stepping off the approach.

Lane conditioning in the bowling game of the present invention will now be described. Oil on the lane (and plate) is not allowed while the bowlers are playing the game. If oil is to be used on the lane for whatever reason it must be used at a time when the bowling center is not open for bowling business and must be wiped clean and dry before any bowling can take place.

Even without oil on the lane dust, dirt and grime can accumulate very quickly and become a detriment to the fairness of the game. With this in mind, the playing surface (including the approaches), the seating area and areas leading to the seating areas should be cleaned each business day.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A duckpin bowling pin for use with a ball, the duckpin bowling pin comprising:

a base portion having a bottom surface;

a cylindrical section integral with said base portion, said cylindrical section having a lower edge and an upper edge, a first distance from said bottom surface to said lower edge being less than a ball radius and a second distance from said bottom surface to said upper edge being greater than a ball radius;

said base portion has a base portion outside surface, said cylindrical section has a cylindrical section outside surface, said bas portion outside surface meets said cylindrical section outside surface;

a shoulder section integral with said cylindrical section, said shoulder section having a decreasing diameter, said shoulder section has a shoulder section outside surface, and said shoulder section outside surface meets said cylindrical section outside surface;

wherein a diameter of said base portion at said bottom surface is less than half of a diameter of said cylindrical section.

2. The duckpin bowling pin of claim 1 further comprising:

a neck section integral with said shoulder section, said neck section having a decreasing diameter along a first neck portion and an increasing diameter along a second neck portion.

3. The duckpin bowling pin of claim 2 further comprising:

a head section integral with said neck section, said head section having an increasing diameter along a first head portion and a decreasing diameter along a second head portion.

4. The duckpin bowling pin of claim 1 wherein:

said first distance is approximately 2 inches.

5. The duckpin bowling pin of claim 1 wherein:

said second distance is approximately 4.5 inches.

6. The duckpin bowling pin of claim 1 wherein:

a height of said duckpin bowling pin is equal to or less than 10 inches.

7. The duckpin bowling pin of claim 1 wherein:

a weight of said duckpin bowling pin is approximately 22 ounces.

8. A set of ten duckpin bowling pins for use with a ball, each duckpin bowling pin comprising:

a base portion having a bottom surface;

a cylindrical section integral with said base portion, said cylindrical section having a lower edge and an upper edge, a first distance from said bottom surface to said lower edge being less than a ball radius and a second distance from said bottom surface to said upper edge being greater than a ball radius;

said base portion has a base portion outside surface, said cylindrical section has a cylindrical section outside surface, said base portion outside surface meets said cylindrical section outside surface;

a shoulder section integral with said cylindrical section, said shoulder section having a decreasing diameter, said shoulder section has a shoulder section outside surface, and said shoulder section outside surface meets said cylindrical section outside surface;

wherein each of said ten duckpin bowling pins is the same.

9. The set of duckpin bowling pins of claim 8 wherein each duckpin bowling pin further comprises:

a neck section integral with said shoulder section, said neck section having a decreasing diameter along a first neck portion and an increasing diameter along a second neck portion.

10. The set of duckpin bowling pins of claim 9 wherein each duckpin bowling pin further comprises:

a head section integral with said neck section, said head section having an increasing diameter along a first head portion and a decreasing diameter along a second head portion.

11. The set of duckpin bowling pins of claim 9 wherein for each duckpin bowling pin, a weight of said duckpin bowling pin is approximately 22 ounces.

12. The set of duckpin bowling pins of claim 8 wherein for each duckpin bowling pin, a diameter of said base portion at said bottom surface is less than half of a diameter of said cylindrical section.

13. The set of duckpin bowling pins of claim 8 wherein for each duckpin bowling pin, said first distance is approximately 2 inches.

14. The set of duckpin bowling pins of claim 8 wherein for each duckpin bowling pin, said second distance is approximately 4.5 inches.

15. The set of duckpin bowling pins of claim 8 wherein for each duckpin bowling pin, a height of said duckpin bowling pin is equal to or less than 10 inches.

16. A duckpin bowling game comprising:

a ball having a ball radius of approximately 2.5 inches;

a duckpin bowling pin having:

a base portion having a bottom surface;

a cylindrical section integral with said base portion, said cylindrical section having a lower edge and an upper edge, a first distance from said bottom surface to said lower edge being less than 2.5 inches and a second distance from said bottom surface to said upper edge being greater than 2.5 inches;

said base portion has a base portion outside surface, said cylindrical section has a cylindrical section outside surface, said base portion outside surface meets said cylindrical section outside surface;

a shoulder section integral with said cylindrical section, said shoulder section having a decreasing diameter, said shoulder section has a shoulder section outside surface, and said shoulder section outside surface meets said cylindrical section outside surface;

wherein a diameter of said base portion at said bottom surface is less than half of a diameter of said cylindrical section.

17. The duckpin bowling game of claim 16 wherein:

said first distance is approximately 2 inches.

18. The duckpin bowling game of claim 16 wherein:

said second distance is approximately 4.5 inches.

* * * * *